US011273567B2

(12) United States Patent
Higgins

(10) Patent No.: US 11,273,567 B2
(45) Date of Patent: Mar. 15, 2022

(54) SAFETY CHOPPER KNIFE

(71) Applicant: Striped Monkey IP, Gastonia, NC (US)

(72) Inventor: Daniel James Higgins, Gastonia, NC (US)

(73) Assignee: STRIPED MONKEY IP, Raleigh, NC (US)

( * ) Notice: Subject to any disclaimer, the term of this patent is extended or adjusted under 35 U.S.C. 154(b) by 0 days.

(21) Appl. No.: 16/673,378

(22) Filed: Nov. 4, 2019

(65) Prior Publication Data

US 2020/0139568 A1 May 7, 2020

Related U.S. Application Data

(60) Provisional application No. 62/756,626, filed on Nov. 7, 2018.

(51) Int. Cl.

| | |
|---|---|
| ***B26B 3/00*** | (2006.01) |
| ***B26B 5/00*** | (2006.01) |
| ***B26D 1/08*** | (2006.01) |
| ***B26B 29/02*** | (2006.01) |
| *B26D 1/00* | (2006.01) |

(52) U.S. Cl.

CPC ..... *B26D 1/08* (2013.01); *B26B 3/00* (2013.01); *B26B 5/007* (2013.01); *B26B 29/025* (2013.01); *B26D 2001/004* (2013.01)

(58) Field of Classification Search

CPC ..... B26B 3/00; B26B 3/04; B26B 58/007; B26B 58/008; B26B 23/00; B26B 29/063; B26B 5/007; B26B 5/008; B26B 3/02; B26B 3/03; A47J 23/00; A21C 15/04; B26D 1/08; B26D 1/09; B26D 2001/004

USPC ..... 30/305, 312, 315, 114

See application file for complete search history.

(56) References Cited

U.S. PATENT DOCUMENTS

| | | | | |
|---|---|---|---|---|
| 631,021 | A * | 8/1899 | Lohr | B26B 23/00 30/305 |
| 1,110,946 | A * | 9/1914 | Lahiere | B26B 23/00 30/305 |
| 1,442,544 | A * | 1/1923 | Schwenke | A47L 13/08 30/170 |
| 5,456,010 | A * | 10/1995 | Bryda | B26B 3/04 30/286 |
| 7,266,894 | B1 * | 9/2007 | Hinckley | B26D 1/0006 30/302 |
| 9,545,112 | B1 * | 1/2017 | Strauss | B26D 3/24 |

(Continued)

*Primary Examiner* — Clark F Dexter

(74) *Attorney, Agent, or Firm* — NK Patent Law

(57) ABSTRACT

A chopping tool for safely chopping food. The chopping tool includes a blade with a blade edge at a distal end, and a spine at a proximal end. The spine includes two lateral edges with a receptor positioned near each lateral edge. The chopping tool also includes two handles engaging the blade, each handle including a scabbard section for grabbing with fingers, a horizontal section extending from the scabbard section towards and engaging the receptor on the spine, and a vertical section protruding from the scabbard section towards the distal end of the blade. Each handle is configured to pivot about a point of contact between a bottom end of the vertical section and a cutting surface to move the blade edge downward towards the cutting surface and upward away from the cutting surface in an alternating fashion for chopping an article placed on the cutting surface.

14 Claims, 10 Drawing Sheets

(56) References Cited

U.S. PATENT DOCUMENTS

| | | | | |
|---|---|---|---|---|
| 10,793,342 | B2 * | 10/2020 | Minson et al. .... | B65D 83/0829 |
| 2004/0250667 | A1 * | 12/2004 | Atwater ..... | B26B 5/008 83/13 |
| 2009/0282990 | A1 * | 11/2009 | Farnum et al. ..... | B26B 3/04 99/537 |

* cited by examiner

SAFETY CHOPPER KNIFE

CROSS-REFERENCE TO RELATED APPLICATIONS

This application claims priority to U.S. Provisional Patent Application No. 62/756,626 filed on Nov. 7, 2018 by Striped Monkey IP entitled "SAFETY CHOPPER KNIFE," the entire contents of which are incorporated by reference herein.

TECHNICAL FIELD

The invention relates to a knife, and, in particular, to a safety chopper knife that reduces or eliminates the chances of accidental cuts.

BACKGROUND

Utility knives are well known and have a wide variety of uses, especially in the context of food preparation in the kitchen. A well-recognized problem with these knives is accidental cuts. This can occur when the user is using the knife for chopping articles such as vegetables, fruits, and meats, for example. In many of the uses of chopping knives, the user is often pulling the knife back towards his/her body, which is the most common way the user gets cut. The likelihood of such an injury is increased when the user is doing repetitive tasks. Many attempts have been made to make chopping knives safer.

Therefore, a need exists for a basic, cost effective, safe-use chopper knife that provides a simple and effective way to cut food or other objects in a way that minimizes the chances of accidental cuts and injuries to the user.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

Disclosed herein is a chopping tool comprising a blade comprising a blade edge at a distal end, and a spine at a proximal end, the spine comprising two lateral edges with a receptor positioned near each lateral edge, and two handles engaging the blade, each handle including a scabbard section for grabbing with fingers, a horizontal section extending from the scabbard section towards and engaging the receptor on the spine, and a vertical section protruding from the scabbard section towards the distal end of the blade. Each handle is configured to pivot about a point of contact between a bottom end of the vertical section and a cutting surface to move the blade edge downward towards the cutting surface and upward away from the cutting surface in an alternating fashion for chopping an article placed on the cutting surface.

According to one or more embodiments, the vertical section is curved near the distal end to provide leverage when the handles are simultaneously moved towards a vertical centerline of the spine to lift blade away from a cutting surface, the vertical centerline perpendicular to a longitudinal axis of the spine.

According to one or more embodiments, the horizontal section is configured to move away from a vertical centerline of the spine and slide further into the receptor when the blade edge moves toward the cutting surface, the vertical centerline perpendicular to a longitudinal axis of the spine.

According to one or more embodiments, the horizontal section is configured to move toward a vertical centerline of the spine when the blade edge moves away from the cutting surface, the vertical centerline perpendicular to a longitudinal axis of the spine.

According to one or more embodiments, the blade is configured to move towards the cutting surface when the handle is pivoted away from a vertical centerline of the spine, the vertical centerline perpendicular to a longitudinal axis of the spine.

According to one or more embodiments, the blade is configured to move away from the cutting surface when the handles are pivoted about the point of contact between the bottom end of the vertical section and the cutting surface toward a vertical centerline of the spine, the vertical centerline perpendicular to a longitudinal axis of the spine.

According to one or more embodiments, the handle further comprises an opening near the proximal end for engaging one or more fingers of an operator.

According to one or more embodiments, the handle further comprises a palm support near the proximal end of the blade for engaging a palm of an operator.

According to one or more embodiments, the vertical sections are configured to engage an article to be chopped.

According to one or more embodiments, the lateral edges of the spine and a top edge of the spine are blunt.

According to one or more embodiments, each handle further includes a balancing spring coiled around the horizontal section extending from the scabbard section towards and engaging the receptor on the spine. The balancing spring provides tension to balance the horizontal section as the horizontal section moves towards and extends into the receptors.

According to one or more embodiments, each balancing spring engages with a spring stopper on the horizontal section.

According to one or more embodiments, each handle further comprises a groove in the vertical section, and the spine further comprises two balls. Each of the balls is positioned to engage one of the grooves in the vertical section. The grooves and the balls are sized such that the engagement between them is sufficient to provide a path for the handles to travel during a chopping cycle.

According to one or more embodiments, the chopping tool further includes a storage station, the storage station comprising a vertical face having one or more magnets configured for attaching the blade thereto, side faces on either side of the central vertical face configured to disengage the blade attached to the magnets by flexing of the side faces, the side faces curving away from the magnet carrying side of the vertical face, and a pedestal supporting the vertical face and the side faces, the pedestal including a receptacle configured to receive bottom ends of the vertical sections of the handle.

Other objects and advantages of this invention will be better appreciated from the following detailed description.

DETAILED DESCRIPTION

Disclosed herein is a chopping tool that permits chopping of food or other objects in a way that minimizes risk of injury to the operator of the tool.

Figure 1:
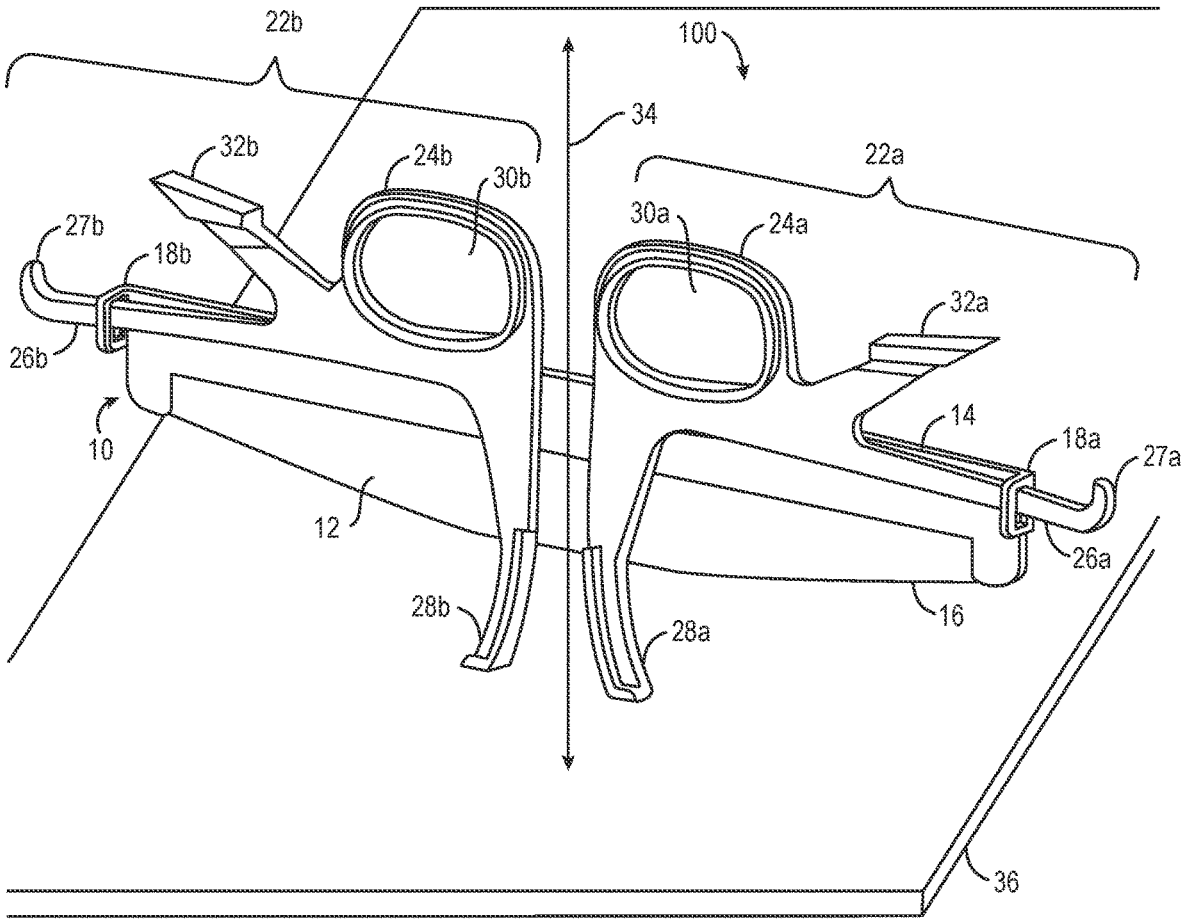
FIG. 1 shows a perspective view of an exemplary embodiment of a safety chopper knife.

FIG. 1 shows a perspective view of an exemplary embodiment of a safety chopper knife.

Referring to FIG. 1, chopping tool 100 comprises a spine/blade assembly 10 and two handles 22*a* and 22*b*. For clarity, in the embodiment shown in FIG. 1, handles 22*a* and 22*b* are mirror images of one another. The relevant portions of handles 22*a*/22*b* have been labeled using "a" and "b" to distinguish the same parts on each of the handles. The parts numbered with "a" on handle 22*a* are the same parts as the corresponding parts numbered with "b" on handle 22*b*. Throughout this specification, the parts will be grouped together for ease of discussion.

The spine/blade assembly 10 includes a blade 12 and a spine 14. Blade 12 includes a blade edge 16 at a distal end, and the spine 14 at a proximal end. Spine 14 includes two lateral edges with receptors 18*a* and 18*b* positioned near each lateral edge. The two handles 22*a* and 22*b* engage the blade 12 in the manner shown in FIG. 1. Each of handle 22*a* and 22*b* includes a scabbard section 24*a*/24*b* for grabbing the chopping tool 100 with fingers of an operator of the chopping tool 100. In the embodiment shown in FIG. 1, the scabbard section 24*a*/24*b* is approximately in the shape of an ellipse. Each of handle 22*a* and 22*b* further includes a horizontal section 26*a*/26*b* extending horizontally from the scabbard section 24*a*/24*b* towards and engaging a receptor 18*a*/18*b* on the spine 14 with hooked end 27*a*/27*b*. Each of handle 22*a* and 22*b* further includes a vertical section 28*a*/28*b* protruding from scabbard section 24*a*/24*b* towards the distal end of the blade 12, as illustrated in FIG. 1. The handles 22*a* and 22*b* are each configured to pivot about a point of contact between a bottom end of the vertical section 28*a*/28*b* and a cutting surface 36 to move the blade edge 16 downward towards the cutting surface 36 and upward away from the cutting surface in an alternating fashion for chopping an article placed on the cutting surface.

As can be seen in FIG. 1, vertical section 28*a*/28*b* may be curved outward (e.g., away from vertical centerline 34) near the distal end to provide leverage when the handles 22*a* and 22*b* are simultaneously moved towards the vertical centerline 34 of the spine to lift blade 12 away from the cutting surface 36, with the vertical centerline 34 being perpendicular to a longitudinal axis of spine 14. Further, the vertical sections 28*a*/28*b* are configured to engage an article to be chopped during cutting or chopping operations. For example, the two vertical sections 28*a* and 28*b* can hold between them an article or multiple articles to be chopped or being chopped. In addition, because of the ability for the handles 22*a* and 22*b* to move horizontally along the longitudinal axis of spine 14, the handles can be opened to gather multiple pieces of the article being chopped and collect those pieces into a pile for the next cut. The vertical sections 28*a*/28*b* of handles 22*a* and 22*b* are used to capture and control the article(s) being chopped.

In one embodiment, a multi-blade configuration is provided such that, for example, two blades 12 are used with handles 22*a* and 22*b* sandwiched between such two blades 12. Such a configuration may advantageously double the amount of chopping achieved per downward motion of the handles 22*a* and 22*b*.

During cutting operations of the chopping tool 100, horizontal sections 26*a*/26*b* with hooked ends 27*a*/27*b* are configured to move away from vertical centerline 34 of spine 14 and slide further into receptors 18*a*/18*b* as the blade edge 16 moves toward the cutting surface 36. Further, during the cutting operations, horizontal sections 26*a*/26*b* with hooked ends 27*a*/27*b* are configured to move toward vertical centerline 34 of spine 14 as the blade edge 16 moves away from the cutting surface 36. Blade 12 is configured to move towards the cutting surface when handles 22*a* and 22*b* are pivoted away from vertical centerline 34 of the spine 14, with the pivot occurring about the point of contact between the bottom end of vertical section 28*a*/28*b* and the cutting surface 36. Additionally, blade 12 is configured to move away from the cutting surface when handles 22*a* and 22*b* are pivoted about the point of contact between the bottom end of vertical section 28*a*/28*b* and the cutting surface 36 toward vertical centerline 34 of spine 14.

As shown in FIG. 1, each of handles 22*a* and 22*b* includes an opening 30*a*/30*b* in scabbard 24*a*/24*b* near the proximal end of the blade 12 for engaging one or more fingers of an operator; each handle further includes a palm support 32*a*/32*b* near the proximal end of blade 12 for engaging a palm of an operator. For the safety of the operator of the chopping tool, the lateral edges of the spine and the top edge of the spine are kept blunt (or rounded). The palm support 32*a*/32*b* allows the operator to apply downward force on the blade 12, which helps make a clean cut of the article(s) being chopped.

The chopping tool as described herein advantageously ensures that no fingers of the operator of the chopping tool are in the cutting zone, thereby reducing the risk of accidental injury to the operator's fingers during the cutting or chopping operations. The chopping tool further advantageously provides for ease of assembly and disassembly. Assembly simply requires inserting the hooked ends 27*a*/27*b* of horizontal sections 26*a*/26*b* into receptors 18*a*/18*b*. Disassembly for cleaning purposes, for example, simply requires disengaging the hooked ends 27*a*/27*b* of horizontal sections 26*a*/26*b* out of the receptors 18*a*/18*b*. The chopping tool allows for easy cleaning by hand. The chopping tool is further made of materials that are dishwasher safe.

The chopping tool as disclosed herein also permits the "capturing" and "controlling" of the article being chopped between the limbs of the vertical sections 28*a* and 28*b*. The chopping tool further allows for a smooth chopping motion as the blade edge 16 moves downward towards the cutting surface 36 to cut an article that is held between the limbs of vertical sections 28*a* and 28*b* as the handles 22*a* and 22*b* are moved away from the vertical centerline 34, and moves upward away from the cutting surface 36 as the handles 22*a* and 22*b* are moved towards the vertical centerline 34. In one embodiment, the chopping tool is configured for operation by a single hand.

As explained above, during the chopping or cutting operation, the two handles 22*a* and 22*b* slide towards the cutting surface 36 to engage food, for example. The vertical sections 28*a* and 28*b* will remain in contact with the cutting surface 36 during the whole time the chopping or cutting operation is underway. Once the handles 22*a* and 22*b* have engaged or "grabbed" the food between the limbs of the vertical section 28*a* and 28*b*, the point of contact between a bottom end of vertical sections 28*a* and 28*b* and a cutting surface 36 become the pivot points, and the blade 12 moves downward in a steady motion. The vertical sections 28*a* and 28*b* are configured to facilitate even chopping. Additionally, the vertical sections 28*a* and 28*b* are curved as shown in FIG. 1 to minimize total movement relative to food during the chopping cycle, and the ends of the limbs of vertical sections 28*a* and 28*b* are shaped to optimize the pivoting and for maintaining food capture. The shape of the ends also facilitates angled cutting. In one embodiment, the curvature of the limb of the vertical sections 28*a* and 28*b* is changed along the length of the vertical section to account for a particular point's distance from the pivot point. The curvature advantageously helps maintain a consistent profile relative to the pivot point during the chopping or cutting process. Further, horizontal sections 26*a*/26*b* and hooked ends 27*a*/27*b* are configured for interacting with receptors 18*a*/18*b* in a manner that optimizes accuracy and precision of the chopping motion.

In some embodiments, additional guiding mechanisms may be provided to facilitate even and controlled movement of each handle relative to the other handle and relative to the blade. The palm supports (labeled as numerals 32*a* and 32*b* in FIG. 1) are an optional feature provided to support an operator's palm for improving the leverage of the cutting motion when the operator applies downward force to the palm support. After the article to be chopped (e.g., a food item) is engaged between the limbs of the vertical section, downward force on palm supports 32*a* and 32*b* and generally on scabbard sections 24*a* and 24*b* facilitates the cutting motion. The handles are further configured for free movement along the face of the blade during all ranges of motion (i.e., chopping, assembly, and disassembly).

The spine 14 and blade 16, taken together, are referred to as the spine/blade assembly 10. The spine 14 has a definitive end such that the exposure to the blade edge is minimized for safety. The width of the blade edge section is selected based on the maximum cutting area developed between the handles and the blade surface. The receptors 18*a*/18*b* at each end of the spine 14 is a closed loop to capture the horizontal sections 26*a*/26*b* of the handles 22*a* and 22*b*. The shape of receptors 18*a*/18*b* coincides with the shape of the handle horizontal section 26*a*/26*b* such that stability of cutting motion is optimized while assembly and disassembly of the handles are not affected.

In one embodiment each of limbs of the vertical sections 28*a*/28*b* may include a spoon configuration, a fork configuration, or a similar other configuration to facilitate better engagement of an article being chopped during the chopping operation. The limbs of the vertical sections 28*a*/28*b* may vary in width and may be an inch (or more) wide for better gripping of an article being chopped.

Figure 2:
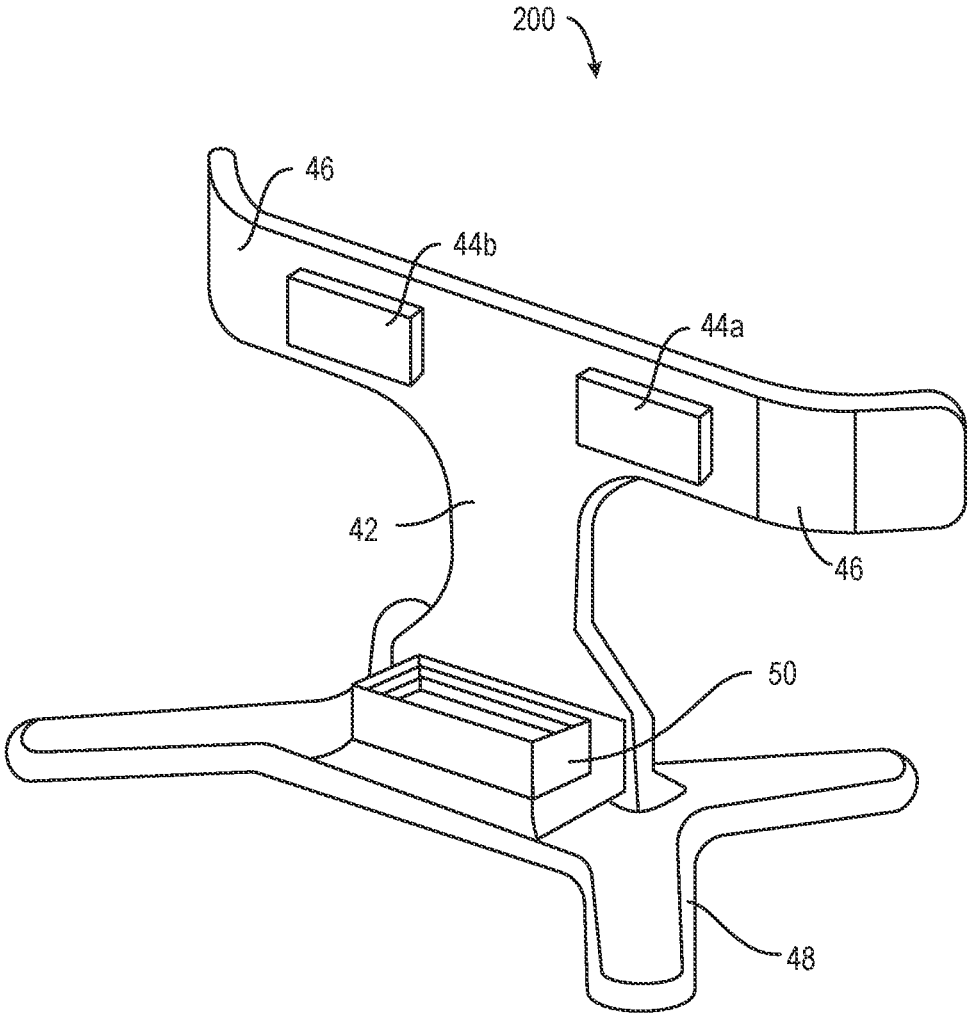
FIG. 2 shows a perspective view of an exemplary embodiment of a storage station for the safety chopper knife.

FIG. 2 shows a perspective view of an exemplary embodiment of a storage station for the safety chopper knife.

Referring to FIG. 2, the chopping tool further includes a storage station 200. As shown in FIG. 2, the storage station 200 comprises a central vertical face 42 having one or more magnets 44*a* and 44*b* configured for attaching blade 12 thereto. The magnets 44*a* and 44*b* magnetically and removably connect to the metal of blade 12 shown in FIG. 1 for storage. Storage station 200 further includes side faces 46 on either side of central vertical face 42. Side faces 46 provide a prying surface to allow a user to push the blade 12 away from the face 42 to disengage the magnets 44*a* and 44*b*. In some embodiments, side faces 46 are capable of flexing such that the side faces 46 can be flexed away from the blade 12 to further assist with disengaging blade 12 attached to magnets 44*a* and 44*b*. As shown in FIG. 2, the side faces 46 curve away from the magnet-carrying side of the vertical face 42 to allow for the user to easily grab hold of side faces 46 such that blade 12 can be disengaged from the magnets 44*a* and 44*b*. Storage station 200 further includes a pedestal 48 supporting the vertical face 42 and the side faces 46. The pedestal further includes a receptacle 50 configured to receive bottom ends of vertical sections 28*a*/28*b* of handles 22*a* and 22*b*.

The storage station 200 is intended to the store chopping tool 100 in general and blade 12 in particular, when not in use; storage station 200 facilitates ease of assembly and disassembly. As explained, the top section of the storage station 200 includes one or more magnets 44*a* and 44*b* on the vertical face 42 located at the center of the top section. The blade 12 will be stored against these magnets. In a storage disposition, the handles 22*a* and 22*b* of chopping tool 100 may be in engagement with receptors 18*a*/18*b* of blade 12, while blade 12 is held in place by magnets 44*a* and 44*b*. The top section includes the two angled or curved side faces 46 directed away from the magnets. Side faces 46 facilitate the "launching" of the blade (and, accordingly, the chopping tool) away from the storage station 200. The storage station 200 also advantageously facilitates the disassembly of handles 22*a*/22*b* from the chopping tool, for example, for cleaning purposes, after the blade is attached to the magnets. In other words, handles 22*a* and 22*b* could be removed while the blade 12 is held in place at the storage station. Similarly, the storage station also advantageously facilitates the assembly of the handles onto the chopping tool when the operator is ready to use the tool (e.g., after the handles have been removed for cleaning) while the blade 12 is held in place at the storage station by the magnets.

The pedestal 48 of storage station 200 is sufficiently wide to maintain stability when the storage station is in use, for example, during the attachment and detachment of blade 12 to/from magnets 44*a* and 44*b*. This ensures that the pedestal 48 remains as motionless as possible in all directions when the storage station is in use. In one embodiment, the storage station is two-sided such that it stores two blades (i.e., one blade on each side) simultaneously, with this configuration providing additional stability to the pedestal 48. Pedestal 48 further includes the molded-in receptacle 50 to receive bottom ends of the vertical sections 28*a*/28*b* of the handles 22*a* and 22*b*. The receptacles may accordingly be sized in order to properly capture the bottoms of the stowed vertical sections 28*a*/28*b* of handles 22*a* and 22*b* to facilitate proper storage of the handles 22*a* and 22*b* along with the blades 12.

In one embodiment, the storage station 200 may be wall-mounted rather than set on a flat surface. In such an embodiment, the storage station 200 does not include pedestal 48.

Figure 3:
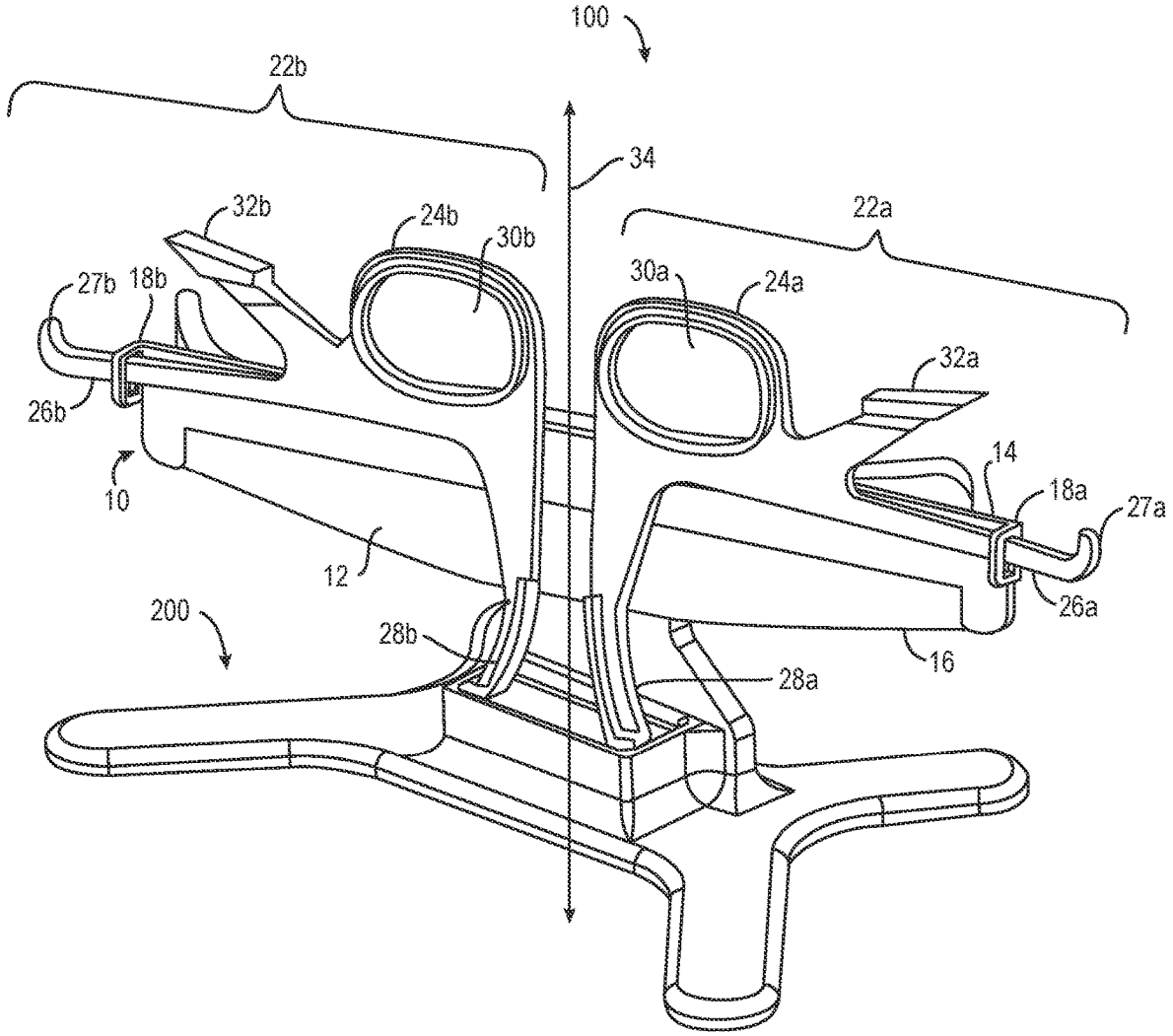
FIG. 3 shows a perspective view of the chopping tool being stored in the storage station.

FIG. 3 shows a perspective view of the chopping tool being stored in the storage station.

Referring to FIG. 3, chopping tool 100 is magnetically engaged to storage station 200 for storage. As shown in FIG.

3, handles 22*a* and 22*b* are in the assembled position with spine 14. The blade 12 of chopping tool 100 is magnetically engaged to magnets 44*a* and 44*b*. The ends of vertical sections 28*a* and 28*b* rest in receptacle 50 of storage station 200.

Figure 4:
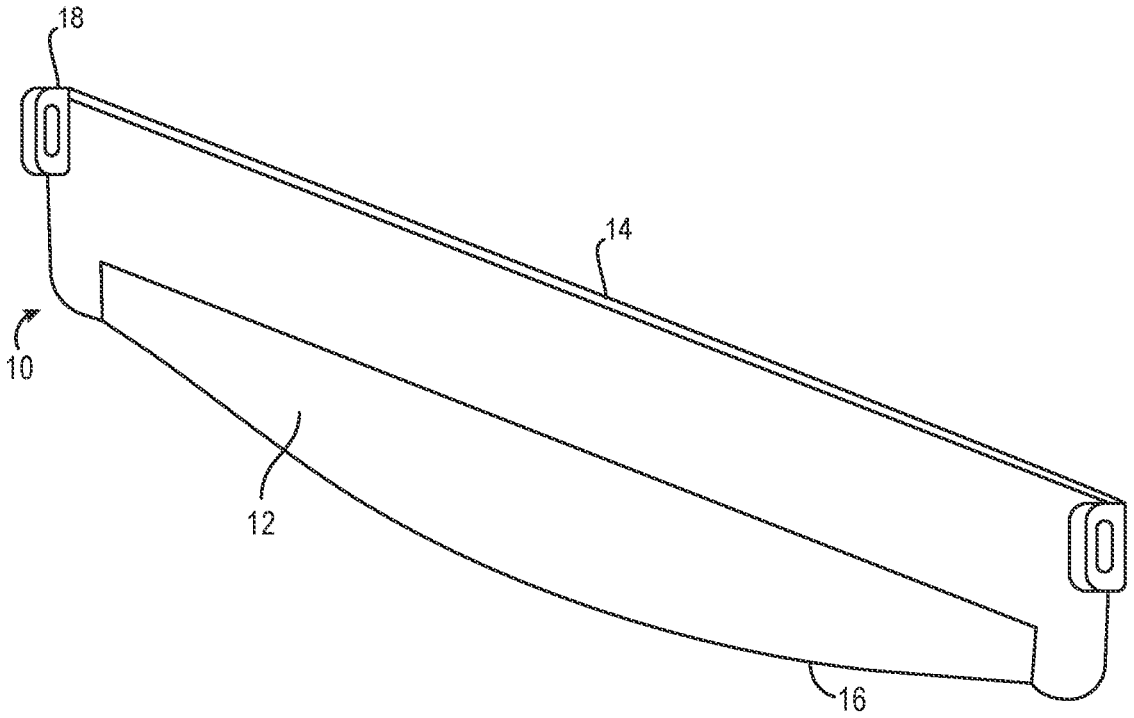
FIG. 4 shows a perspective view of the spine and blade assembly.

FIG. 4 shows a perspective view of the spine and blade assembly.

Referring to FIG. 4, blade 12 is fixed into the spine assembly 14. In one embodiment, blade 12 is permanently fixed in place. In other embodiments, blade 12 is removably fixed into spine assembly 14 such that the blade 12 can be removed for cleaning, sharpening, and or replacement. Blade 12 and/or blade edge 16 may be of a symmetrically convex curved shape as shown in FIG. 4. In other embodiments, blade 12 and/or blade edge 16 may be of other shapes to accommodate different types of chopping operations. For example, the blade may be completely flat, or it may be curved at one end and flat at the other end. In addition, the blade may be serrated for additional cutting applications.

Figure 5:
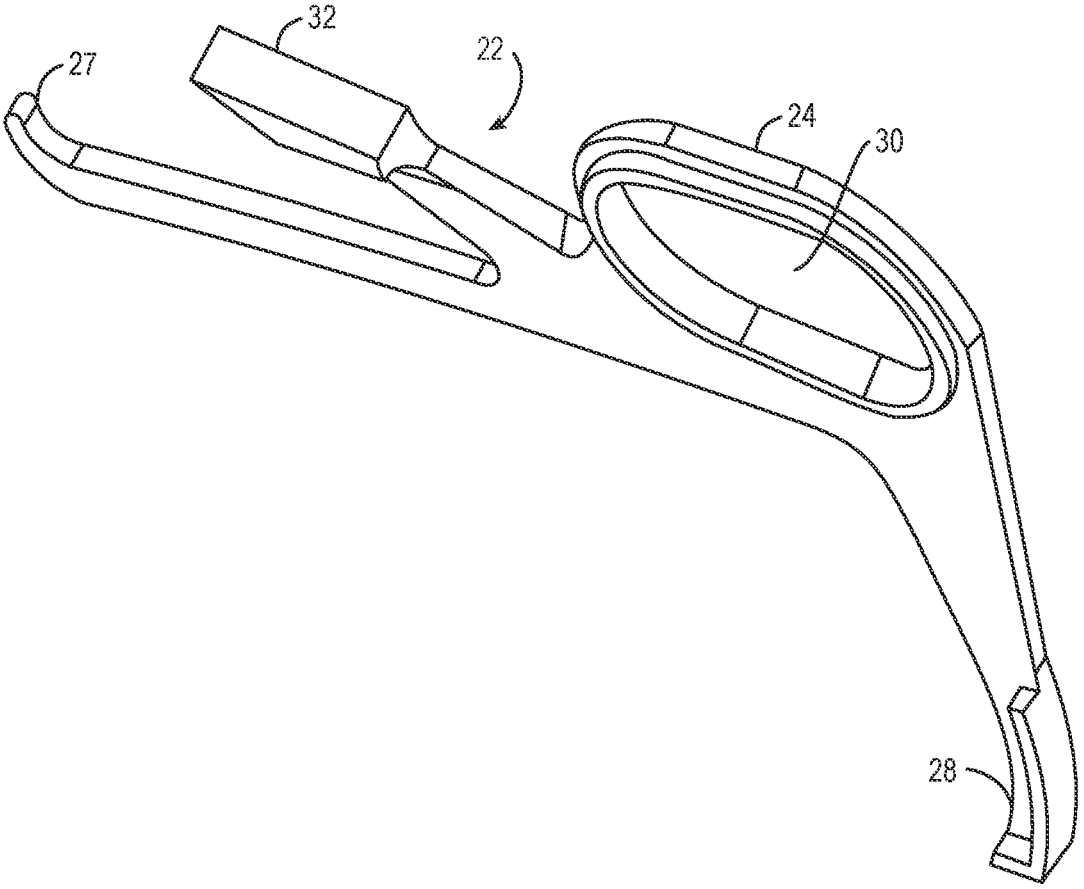
FIG. 5 shows a perspective view of one handle of the chopping tool.

FIG. 5 shows a perspective view of one handle of the chopping tool. As shown in FIG. 5, the handle 22 is removed from the spine and blade assembly. This provides for easy cleaning, storing, and/or transporting of the chopping tool.

Figure 6:
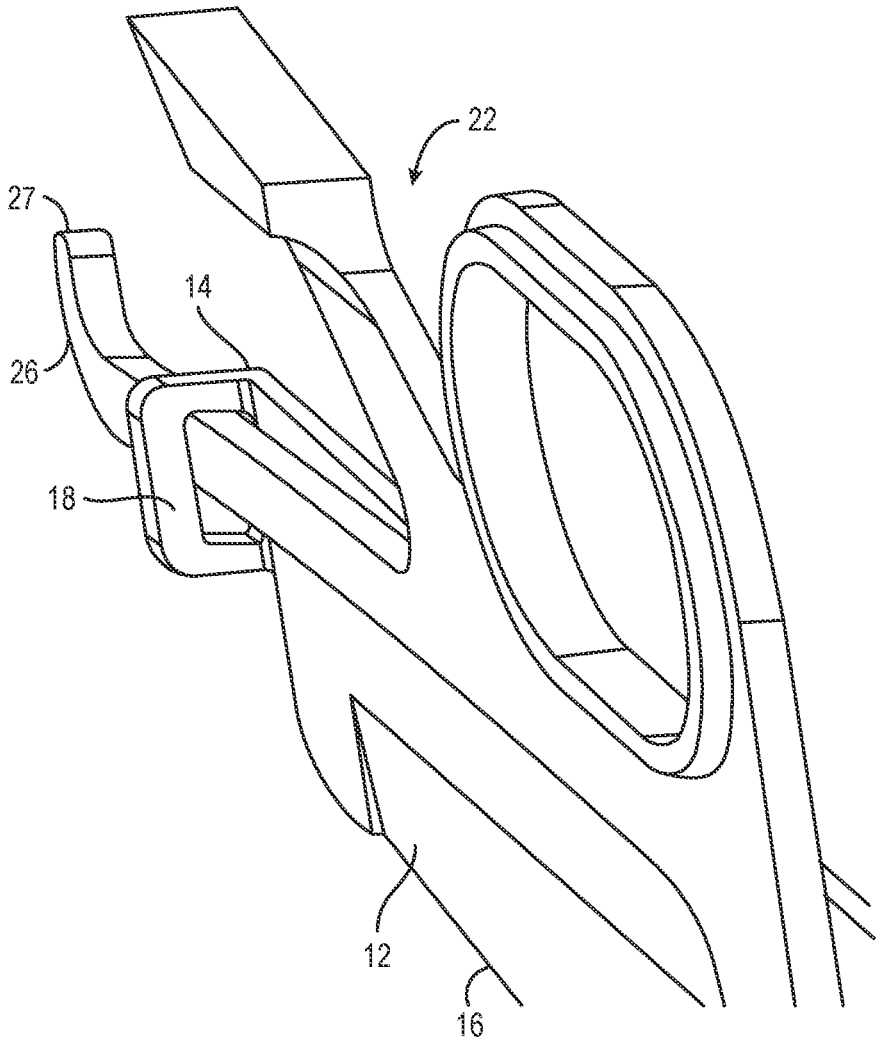
FIG. 6 shows a zoomed-in view of the engagement between one handle and the spine/blade assembly of the chopping tool.

FIG. 6 shows a zoomed-in view of the engagement between one handle and the spine/blade assembly of the chopping tool. As shown in FIG. 6, the horizontal section 26 of handle 22 engages receptor 18. Handle 22 is positioned approximately parallel to spine 14. Hooked end 27 prevents the handle 22 from unintentionally disengaging from spine 14 at receptor 18.

Figure 7A:
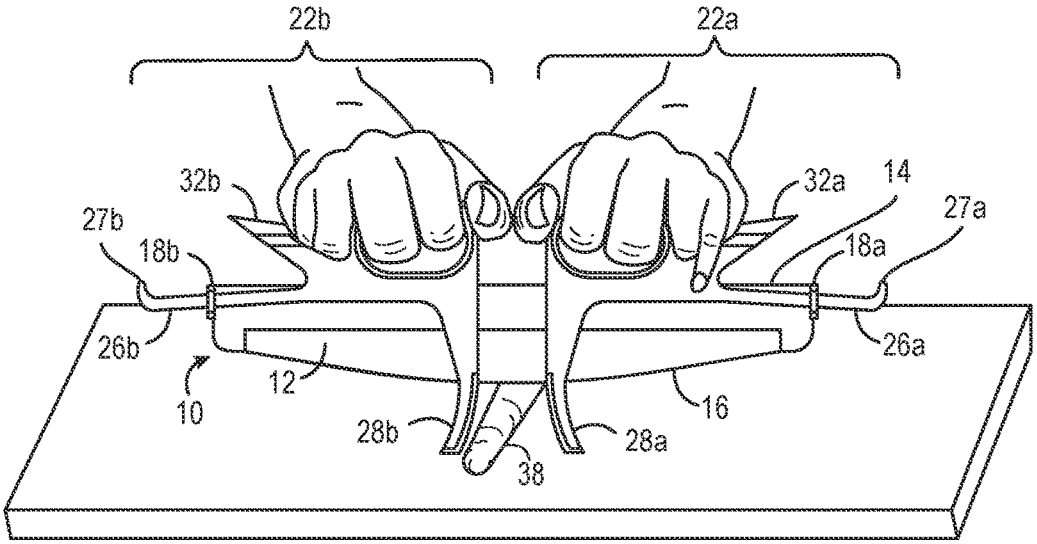
FIGS. 7A-7C show multiple positions of the chopping tool during a chopping cycle.
Figure 7B:
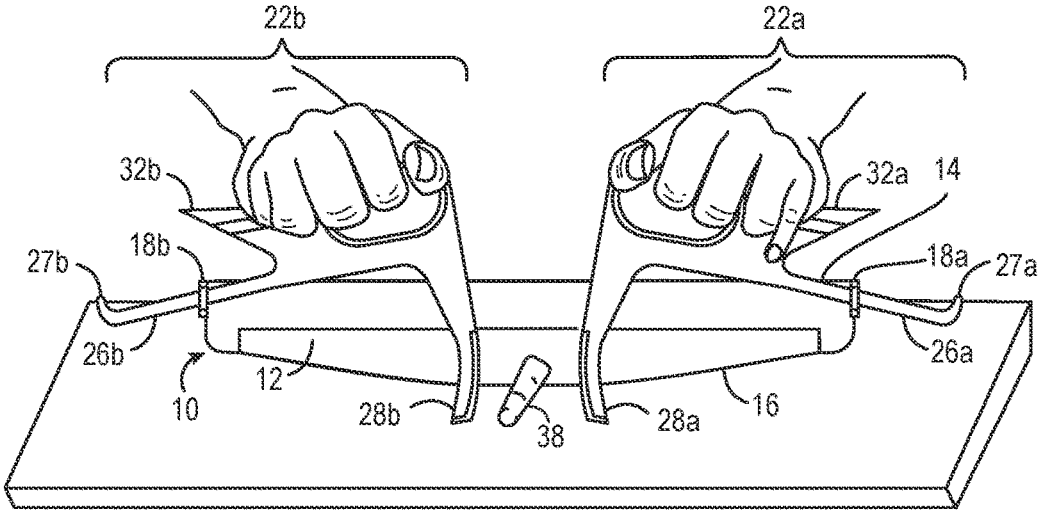
Figure 7C:
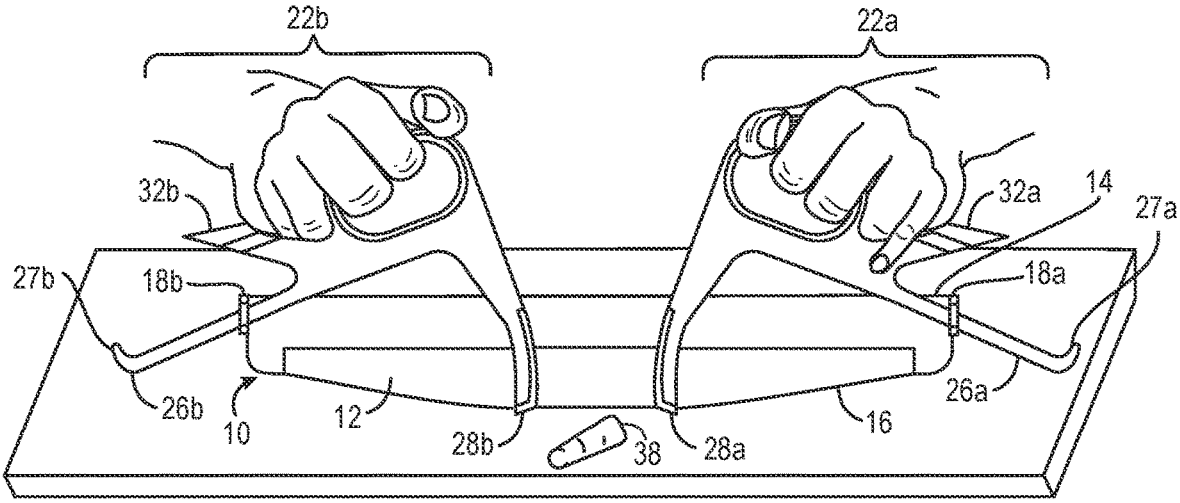

FIGS. 7A-7C show multiple positions of the chopping tool during a chopping cycle. FIG. 7A shows the beginning position of the chopping tool. In the beginning position depicted in FIG. 7A, handles 22*a* and 22*b* are positioned such that horizontal sections 26*a*/26*b* are substantially horizontal and substantially parallel with spine 14. It should be appreciated that there is not any particular required or necessary starting point for the chopping cycle; it is described herein as being in the "up" position with the blade being at its furthest from the cutting surface for ease of description, but that should not be taken as limiting in any way. Vertical sections 28*a* and 28*b* are substantially vertical, and vertical sections 28*a* and 28*b* are used to hold the article 38 to be chopped between them. FIG. 7B shows an intermediate position of the chopping tool, after the chopping motion has been commenced but has not yet completed. As downward force is applied to palm supports 32*a* and 32*b*, each handle 22*a* and 22*b* begins to rotate away from a vertical centerline (e.g., centerline 34 shown in FIG. 1) about the ends of vertical section 28*a* and 28*b*, respectively, which act as pivot points for handles 22*a* and 22*b*. As handles 22*a* and 22*b* rotate away from centerline 34, horizontal sections 26*a* and 26*b* tilt at an angle, forcing the spine/blade assembly 10 to travel downward as the receptors 18*a* and 18*b* are pushed downward by the horizontal sections 26*a* and 26*b*. During the chopping operation, while the chopping tool is in the intermediate position shown in FIG. 7B, blade edge 16 begins to engage the article to be chopped. As more downward force is applied to palm supports 32*a* and 32*b*, the blade edge 16 travels deeper into the article to be chopped. FIG. 7C shows the final position of the chopping tool, after the chopping motion has been completed. As shown in FIG. 7C, the chopping motion has caused the spine/blade assembly 10 to fully engage the article to be chopped, such that the blade goes completely through the article to be chopped and reaches the cutting surface. At this point, the spine/blade assembly 10 will not go any further, and one cycle of chopping has been completed. The chopping tool may be returned to the original position shown in FIG. 7A by rotating handles 22*a* and 22*b* inward towards centerline 34, returning the handles 22*a* and 22*b* back to their original position such that horizontal sections 26*a* and 26*b* are substantially horizontal and substantially parallel to spine 14. This cycle of chopping motion shown in FIGS. 7A-7C may be repeated as many times as necessary to achieve the desired amount of chopping of the article to be chopped (e.g., roughly chopped vs. finely minced).

Figure 8:
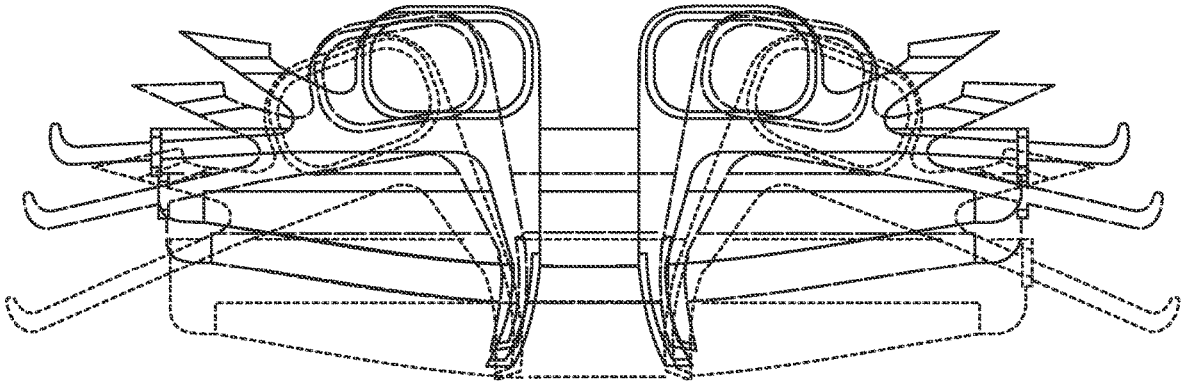
FIG. 8 shows an example of the movement path of the chopping tool throughout a chopping cycle.

FIG. 8 shows an example of the movement path of the chopping tool throughout a chopping cycle. As explained above, the chopping cycle may be repeated as many times as necessary to achieve the desired level of chopping. Between repeated chopping cycles, the vertical limbs may be used to gather/re-gather the chopped pieces into a pile for the next chopping cycle.

Figure 9:
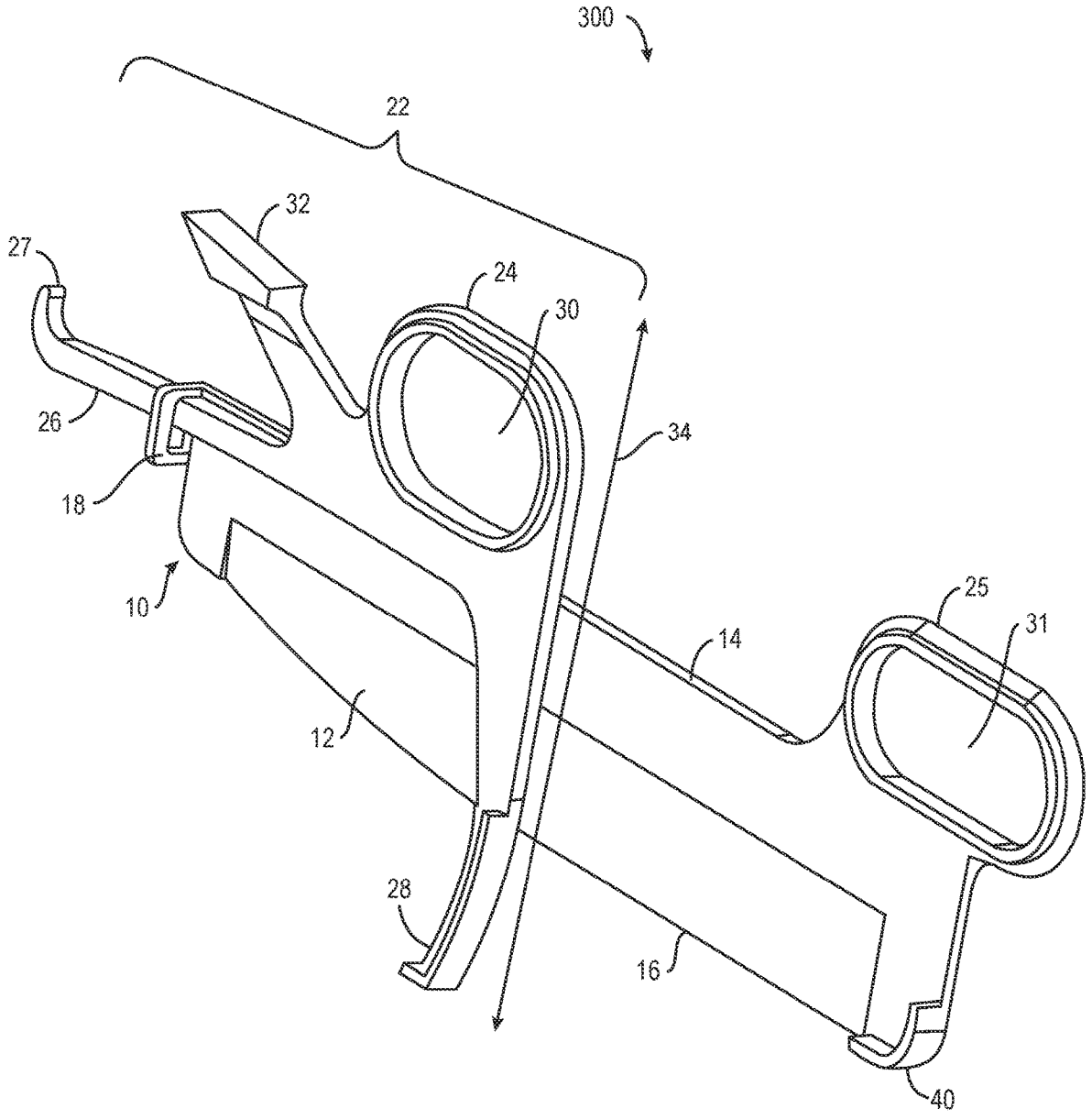
FIG. 9 shows an embodiment of the chopping tool with one handle that is configured for operation by performing the cutting motion with a single hand.

FIG. 9 shows an embodiment of the chopping tool with one handle that is configured for operation by performing the cutting motion with a single hand.

Referring to FIG. 9, handle 22 is similar to handles 22*a* and 22*b* shown in FIG. 1. The embodiment of FIG. 9 differs from the embodiment of FIG. 1 in that the FIG. 9 embodiment has only one handle 22. In the embodiment shown in FIG. 9, spine 14 has a scabbard section 25 with an opening 31 integrated into the end of the spine 14 opposite the end of spine 14 to which handle 22 attaches. Opening 31 and opening 30 are of similar or the same size. The embodiment shown in FIG. 9 further includes pivot point 40. Pivot point 40 is located at the end of the spine 14 opposite the end of spine 14 to which handle 22 attached, distal from opening 31. As can be seen in FIG. 9, the blade edge 16 of blade 12 is substantially flat from approximately centerline 34 to pivot point 40. The operator may hold scabbard 25 using opening 31 by gripping scabbard 25 and putting one or more fingers of one hand through opening 31 and holds scabbard 24 using opening 30 by gripping scabbard 24 and putting one or more fingers of the other hand through opening 30.

In one way of using the embodiment shown in FIG. 9, the operator holds the chopping tool 300 steady about pivot point 40 using the scabbard 25 and/or opening 31 to grip that end of the chopping tool, with pivot point 40 being held at the initial beginning height, similar to where it is held in the embodiment shown in FIG. 1 (e.g., with the spine 14 in a substantially horizontal position). The operator then uses the handle 22 to cause the chopping motion. As the operator holds scabbard 25 relatively steady, the operator applies the repeated cycle of upward force followed by downward force to handle 22, causing blade 12 and blade edge 16 to chop the articles to be chopped.

In another way of using the embodiment shown in FIG. 9, pivot point 40 provides an anchor point that engages with a cutting surface and allows the blade 12 of chopping tool 300 to rock upward and downward from the cutting surface. The flat shape of blade 12 and blade edge 16 allows the blade to cut the articles being chopped between vertical end 28 of handle 22 and pivot point 40. The chopping tool 300 is held by the operator using two hands. By applying a constant downward force to scabbard 25 and/or opening 31, pivot point 40 remains engaged with the cutting surface, while a repeated cycle of upward force followed by downward force is applied to handle 22, causing blade 12 and blade edge 16 to travel in a rocking motion.

Figure 10:
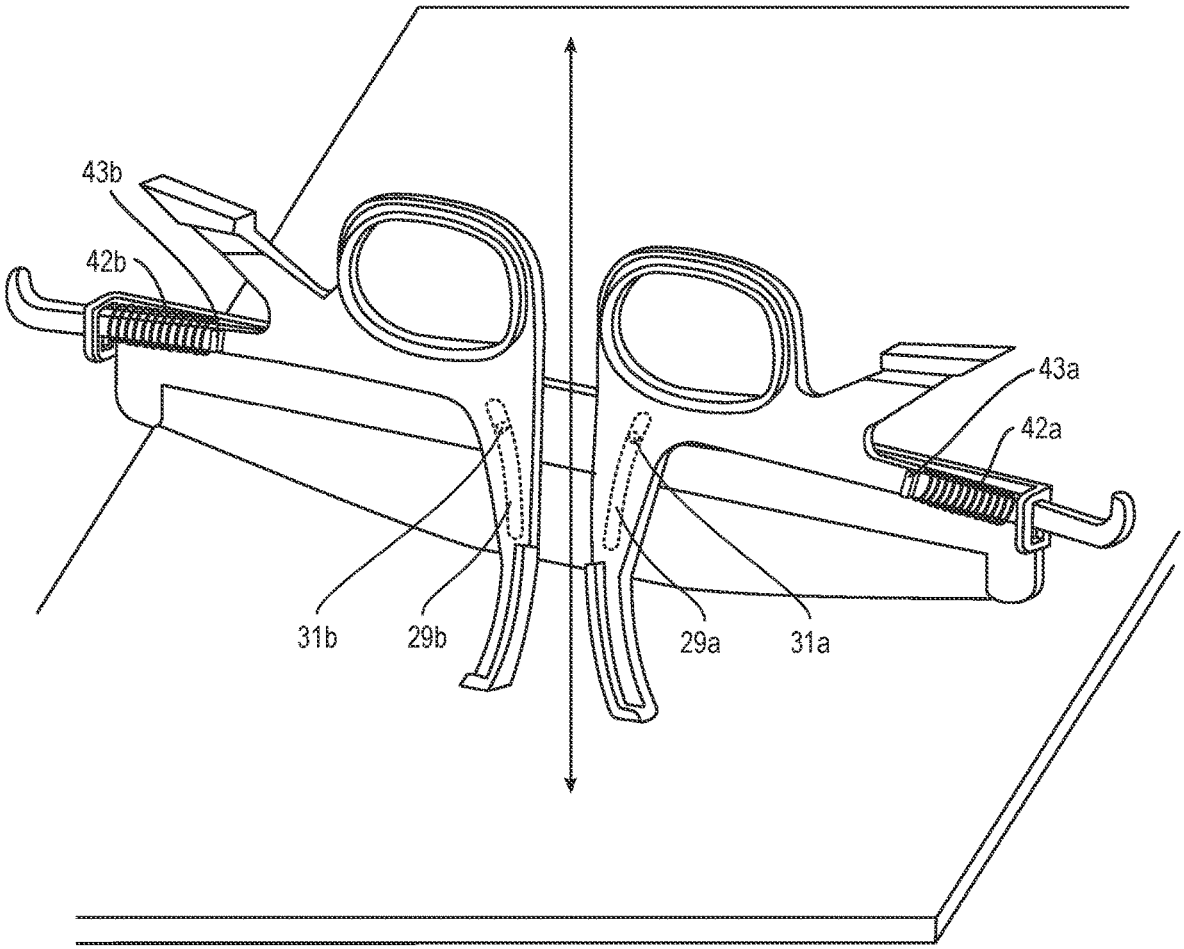
FIG. 10 shows an embodiment of the chopping tool with additional features.

FIG. 10 shows an embodiment of the chopping tool with additional features.

Referring to FIG. 10, the chopping tool may include optional additional features for securing the handles in alignment with the blade and/or additional features for providing a smoother chopping motion. As shown in FIG. 10, the spine/blade assembly may include balls 31*a* and 31*b* for engaging grooves 29*a* and 29*b* on the handles. The balls 31*a*/31*b* on the spine/blade assembly are raised off the surface of the spine/blade assembly and are sized to fit solidly into grooves 29*a*/29*b* such that the chopping path is determined by the grooves 29*a*/29*b*. The grooves 29*a*/29*b* are recessed into their respective handles and provide a track for the handles to travel along such that the handles stay in alignment with the blade, thereby minimizing any opportunity for disengagement of handles from the receptors during the cutting operations to facilitate a further improved chopping operation. The grooves 29*a*/29*b* are sized to solidly engage the balls 31*a*/31*b* such that as the handles are moved, the interaction between the raised balls 31*a*/31*b* and the recessed grooves 29*a*/29*b* forces the path of engagement and movement between the handles and the spine/blade assembly. The balls and grooves may be sized such that they allow for easy assembly/disassembly. This may be accomplished by sizing the balls and grooves such that they fit together using friction but have no blocking mechanism between them. This may also be accomplished by sizing the balls and grooves such that they will only disengage from the grooves at certain points in the grooves, such as at the top, which is outside the normal chopping path. In this case, the grooves may be narrower than the diameter of the balls, such that the grooves provide a blocking mechanism that prevents the balls from coming out of the grooves except at the designated assembly/disassembly point, where the grooves open such that the width is larger than the diameter of the balls.

As further shown in FIG. 10, the chopping tool may further include optional balancing springs 42*a*/42*b* on each of the horizontal sections such that the balancing springs are coiled around the horizontal sections and provide a resistance to the movement of the handle during the chopping cycle, which allows for a smooth feel of movement as perceived by the user of chopping tool. The balancing springs balance the extension of the horizontal sections 26*a*/26*b* into receptors 18*a*/18*b*, respectively, thereby maintaining an even cutting process until such a time as the operator becomes proficient with the cutting mechanism. As the handles are moved toward the lateral end of the spine, the balancing springs are compressed, and as the handles are moved toward the vertical centerline, the springs are decompressed. The horizontal sections of the handles may further include spring stops 43*a* and 43*b* for engaging balancing springs 42*a* and 42*b*, respectively.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a," "an," and "the" refer to "one or more" when used in the subject specification, including the claims. Thus, for example, reference to "a device" can include a plurality of such devices, and so forth.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A chopping tool comprising:

an assembly comprising a blade and a spine, the blade having a blade edge at a distal end thereof, and the spine being opposite the blade edge at a proximal end of the blade, wherein the spine comprises two lateral edges with a receptor positioned near each lateral edge; and two handles connected to the assembly, each handle being movable both linearly and angularly relative to the assembly, and each handle including:

a scabbard section for engaging one or more fingers of a user of the chopping tool, a horizontal section extending from the scabbard section towards and engaging the receptor on the spine, and a vertical section protruding from the scabbard section towards the distal end of the blade, wherein by moving the handle, the vertical section is extendable past the blade edge of the blade and is configured to contact a cutting surface positioned below the chopping tool;

wherein each handle is configured to pivot about a point of contact between the vertical section and the cutting surface to move the blade edge downward towards the cutting surface and upward away from the cutting surface in an alternating fashion for chopping an article placed on the cutting surface.

2. The chopping tool of claim 1, wherein the two handles are connected to the assembly so as to be simultaneously movable towards a vertical centerline of the spine to lift the blade away from the cutting surface, and wherein the vertical section of each handle is curved near the distal end of the blade to provide leverage when the handles are simultaneously moved towards the vertical centerline of the spine to lift the blade away from a the cutting surface, the vertical centerline being perpendicular to a longitudinal axis of the spine.

3. The chopping tool of claim 1, wherein the two handles are connected to the assembly so as to be simultaneously movable away from a vertical centerline of the spine, and wherein the horizontal section of each handle is configured to move away from the vertical centerline of the spine and slide further into the receptor when the blade edge moves toward the cutting surface, the vertical centerline being perpendicular to a longitudinal axis of the spine.

4. The chopping tool of claim 1, wherein the two handles are connected to the assembly so as to be simultaneously movable toward a vertical centerline of the spine, and wherein the horizontal section of each handle is configured to move toward the vertical centerline of the spine when the blade edge moves away from the cutting surface, the vertical centerline being perpendicular to a longitudinal axis of the spine.

5. The chopping tool of claim 1, wherein the blade is configured to move towards the cutting surface when either of the two handles is pivoted away from a vertical centerline of the spine, the vertical centerline being perpendicular to a longitudinal axis of the spine.

6. The chopping tool of claim 1, wherein the blade is configured to move away from the cutting surface when the handles are pivoted about the point of contact between a bottom end of the vertical section and the cutting surface toward a vertical centerline of the spine, the vertical centerline being perpendicular to a longitudinal axis of the spine.

7. The chopping tool of claim 1, wherein each scabbard section of the handle further comprises an opening near the proximal end of the blade to receive the one or more fingers of the user of the chopping tool.

8. The chopping tool of claim 1, wherein each handle further comprises a palm support near the proximal end of the blade for engaging a palm of the user.

9. The chopping tool of claim 1, wherein at least one of the vertical sections of either of the two handles is configured to engage an article to be chopped.

10. The chopping tool of claim 1, wherein the lateral edges of the spine and a top edge of the spine are blunt.

11. The chopping tool of claim 1, wherein each handle further comprises a balancing spring coiled around the horizontal section extending from the scabbard section towards and engaging the receptor on the spine, each balancing spring providing tension to balance the horizontal section as the horizontal section moves towards and extends into the receptors.

12. The chopping tool of claim 11, wherein each balancing spring engages with a spring stopper on the horizontal section.

13. The chopping tool of claim 1, wherein each handle further comprises a groove in the vertical section, and the spine further comprises two balls, wherein each of the balls engages one of the grooves in the vertical section, the grooves and the balls being sized such that the engagement between the grooves and the balls is sufficient to provide a path for the handles to travel during a chopping cycle.

14. The chopping tool of claim 1, further comprising a storage station, the storage station comprising:

a vertical face having one or more magnets configured for attaching the blade thereto;

side faces on either side of the vertical face configured to disengage the blade attached to the one or more magnets by flexing of the side faces, the side faces curving away from a magnet carrying side of the vertical face; and a pedestal supporting the vertical face and the side faces, the pedestal including a receptacle configured to receive a bottom end of each of the vertical sections of the handles.

* * * * *